US010668749B2

(12) United States Patent
Goh et al.

(10) Patent No.: US 10,668,749 B2
(45) Date of Patent: Jun. 2, 2020

(54) INLINE DUPLEXER MEDIA PATH

(71) Applicant: Hewlett-Packard Development Company, L.P., Houston, TX (US)

(72) Inventors: Jun Hong Goh, Singapore (SG); Xiaoxi Huang, Singapore (SG); Lian Chye Tan, Singapore (SG); Wei Lit Teoh, Singapore (SG)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/083,053

(22) PCT Filed: Jun. 22, 2016

(86) PCT No.: PCT/US2016/038718
§ 371 (c)(1),
(2) Date: Sep. 7, 2018

(87) PCT Pub. No.: WO2017/222517
PCT Pub. Date: Dec. 28, 2017

(65) Prior Publication Data

US 2019/0100042 A1 Apr. 4, 2019

(51) Int. Cl.

| | |
|---|---|
| ***B41J 13/02*** | (2006.01) |
| ***B41J 3/60*** | (2006.01) |
| ***B41J 13/00*** | (2006.01) |
| ***B65H 85/00*** | (2006.01) |
| ***B65H 29/14*** | (2006.01) |

(Continued)

(52) U.S. Cl.
CPC ..... *B41J 13/025* (2013.01); *B41J 3/60* (2013.01); *B41J 13/0045* (2013.01); *B41J 13/103* (2013.01); *B41J 13/22* (2013.01); *B65H 29/125* (2013.01); *B65H 29/14* (2013.01); *B65H 29/20* (2013.01); *B65H 29/58* (2013.01);
(Continued)

(58) Field of Classification Search
CPC .... B41J 13/025; B41J 13/0045; B41J 13/103; B41J 13/22
See application file for complete search history.

(56) References Cited

U.S. PATENT DOCUMENTS 6,633,740 B2 10/2003 Estabrooks
7,210,758 B2 5/2007 Corner et al.
(Continued)

FOREIGN PATENT DOCUMENTS

CN 103660625 A 3/2014
CN 104890380 A 9/2015
(Continued)

OTHER PUBLICATIONS

Printek ~ FormsPro 4600 Series, Operator's Manual ~ 2003 ~ 82 pages http://www.printek.com/media/.

*Primary Examiner* — Jason S Uhlenhake
(74) *Attorney, Agent, or Firm* — Brooks, Cameron & Huebsch PLLC

(57) ABSTRACT

In one example, a system for a inline duplexer media path includes a first print media pathway extending from an input roller to an output roller, wherein the first print media pathway provides the print media through a print zone, and a second print media pathway extending from the output roller to the input roller, wherein the second print media pathway is substantially parallel and separate from the first print media pathway.

15 Claims, 4 Drawing Sheets

(51) Int. Cl.

| | |
|---|---|
| ***B65H 29/12*** | (2006.01) |
| ***B65H 29/58*** | (2006.01) |
| ***B41J 13/10*** | (2006.01) |
| ***B41J 13/22*** | (2006.01) |
| ***B65H 29/20*** | (2006.01) |

(52) U.S. Cl.
CPC ... *B65H 85/00* (2013.01); *B65H 2301/33312* (2013.01); *B65H 2404/632* (2013.01)

(56) References Cited

U.S. PATENT DOCUMENTS

| | | | | |
|---|---|---|---|---|
| 7,680,448 | B2 | 3/2010 | Mandel et al. | |
| 7,693,479 | B2 | 4/2010 | Chae | |
| 7,784,783 | B2 | 8/2010 | Teo | |
| 8,366,099 | B2 | 2/2013 | Cook | |
| 2006/0280534 | A1 | 12/2006 | Cook et al. | |
| 2014/0063162 | A1* | 3/2014 | Iijima ..... | B41J 13/009 347/104 |
| 2015/0098741 | A1 | 4/2015 | Endo | |
| 2016/0090258 | A1 | 3/2016 | Sano et al. | |

FOREIGN PATENT DOCUMENTS

| | | | |
|---|---|---|---|
| CN | 105235396 | A | 1/2016 |
| CN | 105291608 | A | 2/2016 |
| JP | 2008230861 | | 10/2008 |
| JP | 2009051618 | A | 3/2009 |

* cited by examiner

INLINE DUPLEXER MEDIA PATH

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make duplexing processes difficult.

DETAILED DESCRIPTION

Figure 1:
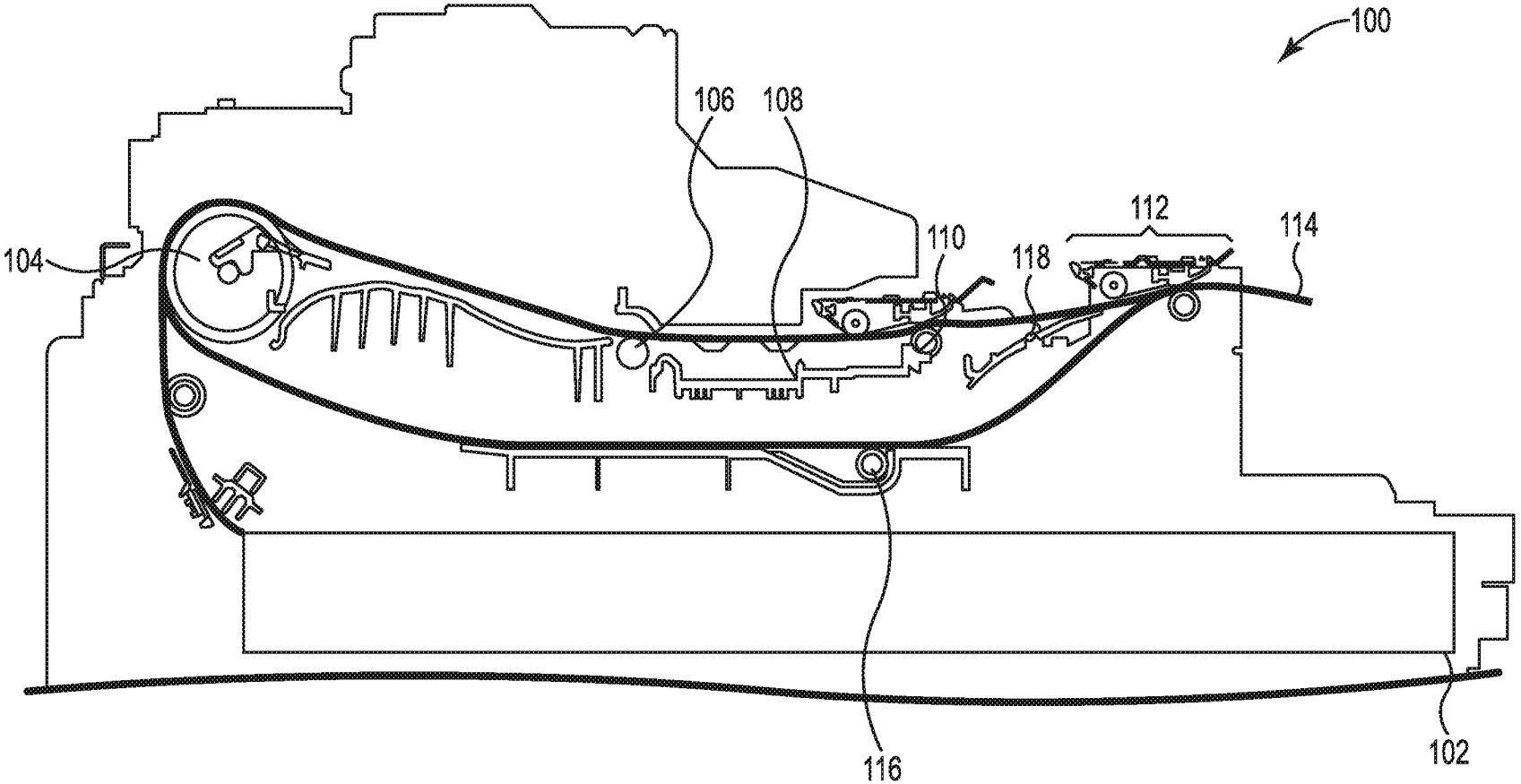
FIG. 1 illustrates an example system for an inline duplexer media path consistent with the present disclosure.

A number of systems, devices, and methods for an inline duplexer media path are described herein. In some examples, a system for an inline duplexer media path can include a first print media pathway extending from an input roller to an output roller, wherein the first print media pathway provides the print media through a print zone, and a second print media pathway extending from the output roller to the input roller, wherein the second print media pathway is substantially parallel and separate from the first print media pathway. As used herein, partially dried inkjet media can include media with applied printing fluid from an inkjet type printing device that is not completely dried on the media.

The partially dried inkjet media can provide difficulties when stacking, aligning, and/or finishing. For example, the partially dried inkjet media can have distorted properties such as a curl, a cockle, a reduction in stiffness, increased surface roughness, extruding fibers from the surface, misaligned fibers, and/or increased sheet to sheet friction of the media. In some examples, these distorted properties can be caused by printing fluid deposited on the media and the media absorbing the printing fluid. For example, the printing fluid can be in a liquid state that can be absorbed by a media such as paper. In this example, the liquid state of the printing fluid can cause the distorted properties of the media in a similar way that other liquids may distort the properties of the media.

The systems, devices, and methods for an inline duplexer media path can include utilizing multiple print media pathways to provide double sided printing on print media. In some examples, a first print media pathway can include a print zone. In some examples, the print zone can be an area where printing fluid is applied to the print media. In some examples, the first print media pathway can receive a first edge of the print media from a print media tray and provide the print media to the print zone with a first side exposed to the print zone. In some examples, a second print media pathway may not include the print zone and/or is separate from the first print media pathway. In some examples, the second print media pathway can provide a second edge of the print media from an output tray to the first print media pathway. In these examples, the first print media pathway can provide the print media to the print zone with a second side exposed to the print zone.

In some examples, the systems, devices, and methods for an inline duplexer media path can include a flipper gate between the print zone of the first print media pathway and an output roller of a printing device. In some examples, the flipper gate can allow print media to pass over a first side of the flipper gate to an output tray. In some examples, the output roller can be a reversible roller that can provide a portion of the print media from the first print media pathway to the output tray. In these examples, the print media can be pinched and the output roller can reverse directions to provide the print media towards the flipper gate. In these examples, the flipper gate can direct the print media to a second print media pathway and provide the print media back to the first print media pathway. In these examples, the print media can be provided to the first print media pathway at an opposite edge of the print media compared to when the print media is provided from a print media tray.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

FIG. 1 illustrates an example system 100 for an inline duplexer media path consistent with the present disclosure. In some examples, the system 100 can be an inkjet printing device capable of dual sided printing on print media 114 (e.g., paper, plastic, etc.). In some examples, the system 100 can include a print media tray 102. In some examples, the print media tray 102 can receive a plurality of print media 114 to be utilized within the system 100.

In some examples, the print media 114 from the print media tray 102 can be removed from the print media tray 102 at a first edge by a first input roller. In some examples, the first input roller can provide the print media to a second input roller 104. In some examples, the second input roller 104 can be a starting point of a first print media pathway. In some examples, the first print media pathway can include a print zone roller 106 to provide the print media 114 to a print zone 108. As described herein, the print zone 108 can be utilized to deposit printing fluid on a first side of the print media 114. In some examples, the print media 114 can be provided to a first output roller 110 as partially dried inkjet media.

In some examples, the first output roller 110 can be utilized to move the print media 114 over a flipper 118 to a clamping device 112. In some examples, the print media 114 can pass over the flipper 118 and the flipper 118 can provide the print media 114 to the clamping device 112. In some examples, the flipper 118 can be an end point of the first print media pathway. That is, the print media 114 can exit the first print media pathway when the print media 114 passes the flipper 118. In some examples, the flipper 118 can be in a first position to allow the print media 114 to pass the flipper 118 and change to a second position when the print media 114 has passed the flipper 118.

In some examples, the clamping device 112 can include a second output roller 112-1 and a clamp 112-2. In some examples, the second output roller 112-1 can be reversible roller that can provide the print media 114 to an output tray (not shown) and/or provide the media back to the flipper 118. In some examples, the clamp 112-2 can clamp a second edge of the print media 114 and prevent the print media 114 from being completely provided to the output tray. In some examples, the clamp 112-2 can be utilized to clamp the second edge of the print media 114 when printing fluid is to be applied to a second side of the print media 114. For example, it can be determined that the print media 114 is to be utilized for a dual sided print job. In this example, a first side of the print media 114 can have printing fluid applied to the first side at the print zone 108 when the print media 114 passes through the first print media pathway. In this example, the clamp 112-2 can clamp the second edge of the print media 114 and allow a portion of the print media 114 to be provided to the output tray. In this example, the second output roller 112-1 can reverse the direction and provide the print media 114 to the flipper 118.

In some examples, the clamping device 112 can be adjustable. For example, the clamping device 112 can include a number of actuators to raise and lower a height of the clamping device 112. In some examples, the clamping device 112 can raise or lower a height based on a position of the print media 114. For example, the clamping device 112 can be lowered or activated when the print media 114 is to be provided to the second print media pathway and/or the duplex roller 116. In this example, the clamping device 112 can be lowered to clamp the print media 114 with the clamp 112-2 and reverse the second output roller 112-1 to provide the print media 114 back to the flipper 118, In some examples, the clamping device 112 can be raised or deactivated so that the clamping device 112 does not interact with the print media 114. In some examples, the clamping device 112 can be deactivated when the print media 114 is not going to be utilized for dual sided printing and/or is not going to be provided back to the flipper 118. In some examples, the clamping device 112 can be raised or deactivated when the print media 114 is provided to the flipper 118 and/or duplex roller 116. In this example, the duplex roller 116 can be utilized to provide the print media 114 to the second input roller 104 so that a second side of the print media 114 can be provided to the print zone 108. In this example, a first portion of the print media 114 can be on the output tray when a second portion of the print media 114 reaches the clamping device 112. In this example, the clamping device 112 can be raised to allow the second portion of the print media 114 to move over the first portion of the print media 114 on the output tray.

As described herein, the flipper 118 can be in a position that blocks the print media 114 from entering the first print media pathway and allow the print media 114 to enter the second print media pathway. In some examples, the flipper 118 can direct the print media 114 to a duplex roller 116. In some examples, the duplex roller 116 and the second print media pathway can be positioned between the first print media pathway and the print media tray 102. In some examples, the second print media pathway can be substantially parallel to the first print media pathway. That is, the second print media pathway can be aligned in the same horizontal direction as the first print media pathway, but not cross the first print media pathway.

In some examples, the duplex roller 116 can provide the print media 114 to the second input roller 104. As described herein, the duplex roller 116 can provide a second edge of the print media 114 to the second input roller 104. In some examples, the second input roller 104 can provide the second edge of the print media 114 to the print zone roller 106. In these examples, the print zone roller 106 can provide the print media 114 to the print zone 108 with a second side of the print media 114 exposed to the print zone 108. In these examples, the print media 114 can have printing fluid deposited on the first side and the second side of the print media 114.

When printing fluid is deposited on the second side of the print media 114 at the print zone 108, the print media 114 can be provided to the first output roller 110. In some examples, the first output roller 110 can provide the print media 114 to the clamping device 112. In some examples, the clamping device 112 can provide the print media 114 to the output tray.

In some examples, the first print media pathway and the second print media pathway can be separate and distinct pathways. In some examples, the second print media pathway can be utilized to provide the print media to the first print media pathway at a second edge of the print media 114 to allow a first side and a second side of the print media 114 to be provided to the print zone 108. In some examples, the second print media pathway can allow the partially dried inkjet media (e.g., print media 114, etc.) to further dry, which can aid in stiffening the partially dried inkjet media for the print zone 108.

Figure 2:
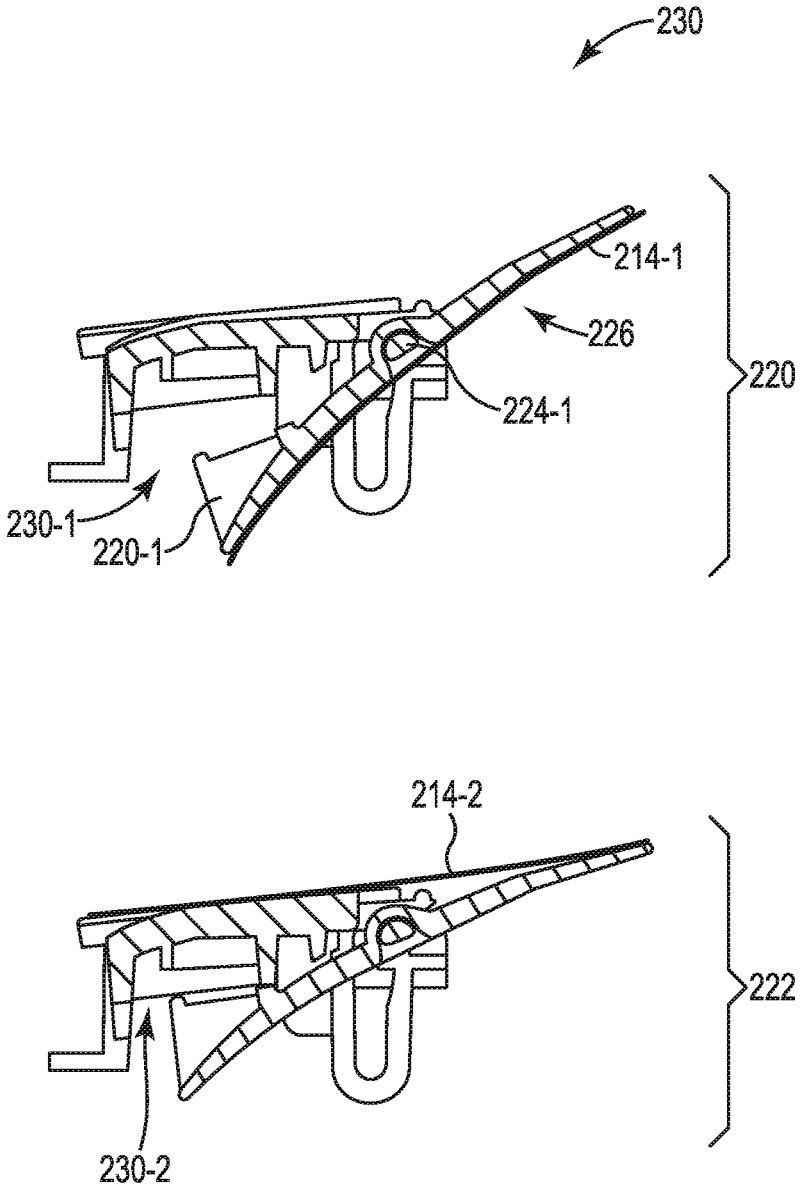
FIG. 2 illustrates an example flipper for an inline duplexer media path consistent with the present disclosure.

FIG. 2 illustrates an example flipper 218 for an inline duplexer media path consistent with the present disclosure. In some examples, the flipper 218 can be the same device or system as flipper 118 as referenced in FIG. 1. In some examples, the flipper 218 can be utilized to direct print media 214-1, 214-2 between a first print media pathway and a second print media pathway. In some examples, the flipper 218 can be a passive flipper. For example, the flipper 218 can be a spring loaded flipper to allow print media to pass over the flipper 218 at the end of the first print media pathway and allow print media to pass under the flipper 218 at the beginning of the second print media pathway.

In some examples, the flipper 218 can include a pivot point 224-1, 224-2. In some examples, the pivot point 224-1, 224-2 can be utilized to pivot a first side arm and a second pivot arm. In some examples, the flipper 218 can be in a first position 220 to direct print media 224-1 to a second print media pathway. In some examples, the first position 220 can be enabled when the print media 214-1 is provided by a second output roller (e.g., second output roller 112-1 as referenced in FIG. 1, etc.). In some examples, the first position 220 can be a spring loaded default position that is altered to a second position 222 when the print media 214-2 is being directed to the second output roller. For example, the first position 220 can be enabled to expose a first side 226 to receive the print media 214-1 from the second output roller as described herein. In this example, the first position 220 can receive the print media 214-1 from the second output roller and direct the print media 214-1 to a second print media pathway.

In some examples, the flipper 218 in the second position 222 can be utilized to receive print media 214-2 from a print zone. In some examples, the flipper 218 can include a second side 228 to receive the print media 214-2 from the print zone and/or the print zone roller as described herein. In these examples, the flipper 218 can rotate via the pivot point 224-1, 224-2 between the first position 220 and the second position 222. In some examples, the flipper 218 can include a limiter 230-1, 230-2. In these examples, the limiter 230-1, 230-2 can stop the flipper 218 at the second position 222.

Figure 3:
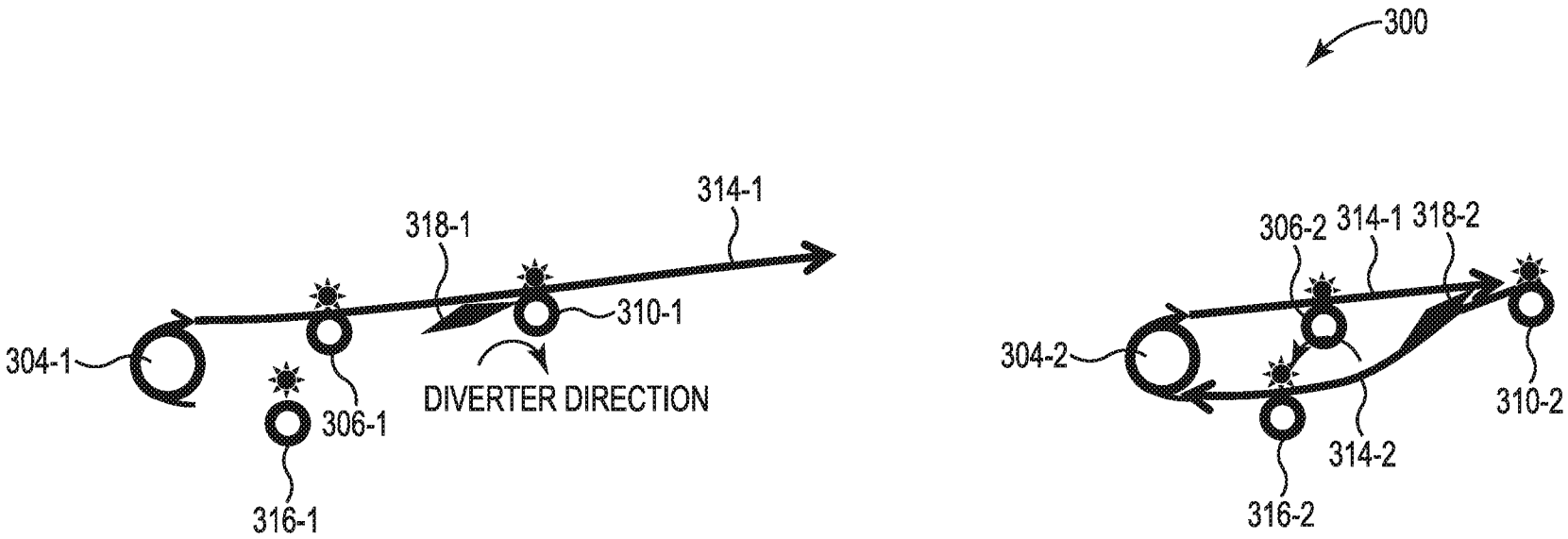
FIG. 3 illustrates an example system for an inline duplexer media path consistent with the present disclosure.

FIG. 3 illustrates an example system 300 for an inline duplexer media path consistent with the present disclosure. In some examples, the system 300 can be a representation of system 100 as referenced in FIG. 1. In some examples, the system 300 can include the same or similar features as system 100 as referenced in FIG. 1. In some examples, the system 300 can illustrate how a flipper 318-1, 318-2 can function to direct print media 314-1, 314-2 between a first print media pathway and a second print media pathway.

In some examples, the system 300 can include an input roller 304-1 to provide the print media 314-1 to a first print media pathway as described herein. In some examples, the system 300 can include a print zone roller 306-1 that can provide a first edge and first side of the print media 314-1 to a print zone. In some examples, the system 300 can include a flipper 318-1. In some examples, the flipper 318-1 can pivot in the diverter direction as illustrated in FIG. 3. In some examples, the flipper 318-1 can allow the print media 314-1 to pass over the flipper 318-1 and be received by an output roller 310-1. As described herein, the output roller 310-1 can provide the print media 314-1 to an output tray. In some examples, the output roller 310-1 can be reversible roller capable of directing the print media 314-1 to the output tray and direct the print media 314-1 back to the flipper 318-1 as described herein. In some examples, the output roller 310-1 can include a clamp to stop the print media 314-1 at a second edge of the print media 314-1 and allow the output roller 310-1 to reverse and provide the second edge of the print media 314-1 to a second print media pathway that is below the first print media pathway.

In some examples, the print media 314-1 can pass the flipper 318-2 and the flipper can pivot in the opposite direction of the diverter direction illustrated in FIG. 3. In some examples, the print media 314-2 can enter the second print media pathway and be received by a duplex roller 316-2. As described herein, the duplex roller 316-2 can provide a second edge of the print media 314-2 to the input roller 304-2. In some examples, the input roller 304-2 can provide the second edge and second side of the print media 314-1 to the print zone roller 306-2. In some examples, the output roller 310-2 can provide the print media 314-1 to the output tray.

Figure 4:
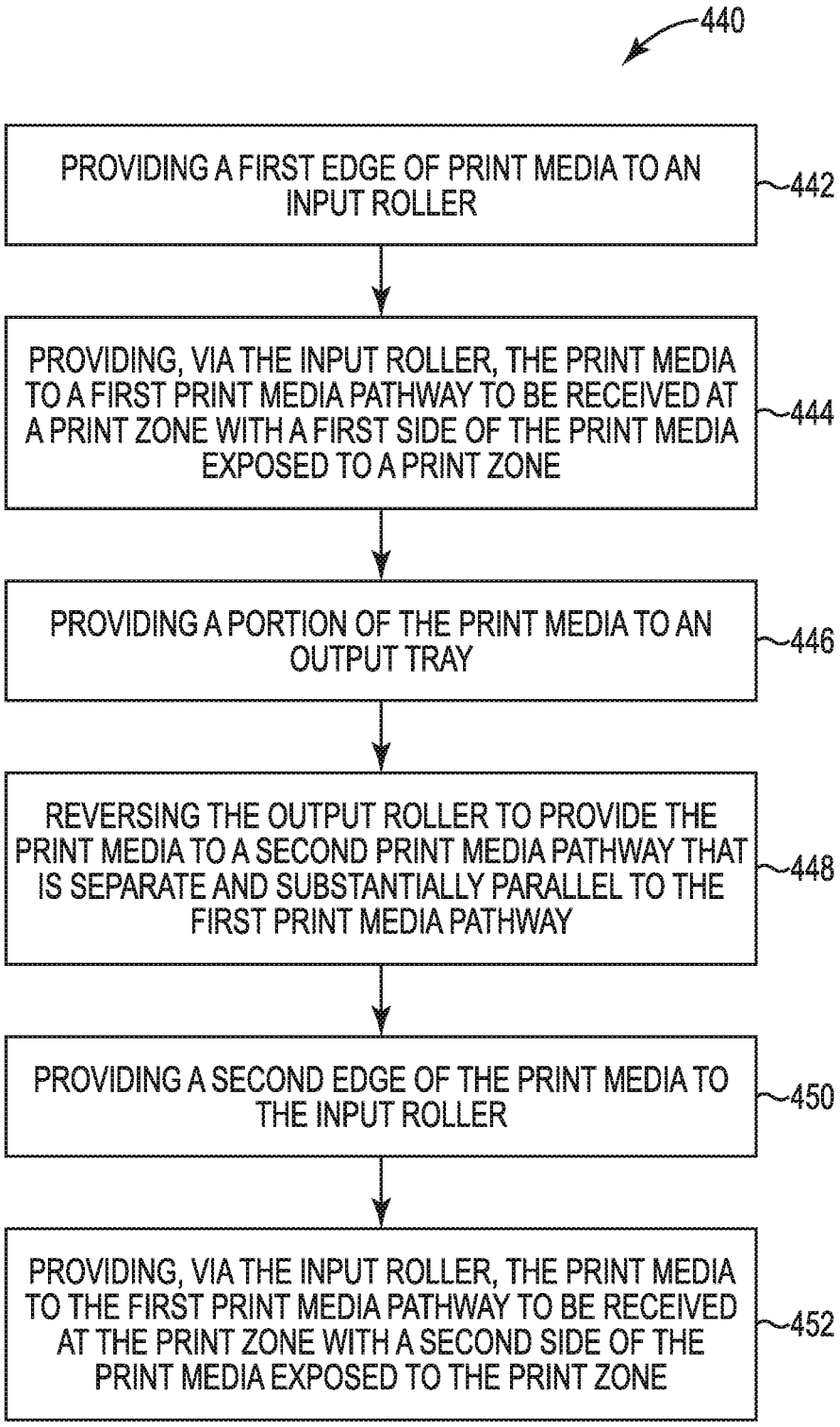
FIG. 4 illustrates an example method for an inline duplexer media path consistent with the present disclosure.

FIG. 4 illustrates an example method 440 for an inline duplexer media path consistent with the present disclosure. In some examples, the method 440 can be performed by a system 100 as referenced in FIG. 1 and/or by a system 300 as referenced in FIG. 3. In some examples, the method 440 can provide dual sided printing of the print media.

At 442, the method 440 can include providing a first edge of print media to an input roller. As described herein, the first edge of the print media can be provided to an input roller by an additional input roller between a print media tray and the input roller.

At 444, the method 440 can include providing, via the input roller, the print media to a first print media pathway to be received at a print zone with a first side of the print media exposed to a print zone. In some examples, providing the print media to a first print media pathway can allow the print zone to deposit printing fluid on the first side of the print media as described herein.

At 446, the method 440 can include providing a portion of the print media to an output tray. As described herein, an output roller or clamping device can provide the first edge of the print media to the output tray and clamp a second edge of the print media. In some examples, the output roller can be a reversible roller to direct the print media back to a flipper. In some examples, the flipper can direct the print media to a second print media pathway as described herein. In some examples, providing a portion of the print media to an output tray can include passing the print media through the output roller and activating a flipper to open the second print media pathway. As described herein, activating the flipper can close the first print media pathway for the print media.

At 448, the method 440 can include reversing the output roller to provide the print media to a second print media pathway that is separate and substantially parallel to the first print media pathway. As described herein, the second print media pathway can be a stand alone print media pathway from the first print media pathway. In some examples, the second print media pathway can be utilized to return the print media to the first print media pathway. In some examples, the second print media pathway can be utilized to increase drying of the print media to increase stiffness of the print media before being received by the print zone.

At 450, the method 440 can include providing a second edge of the print media to the input roller. As described herein, providing the second edge of the print media to the input roller can position the print media on a second side for the print zone, which can allow the print zone to deposit printing fluid on the second side.

At 452, the method 440 can include providing, via the input roller, the print media to the first print media pathway to be received at the print zone with a second side of the print media exposed to the print zone. In some examples, the print media, which has been printed on both sides, can be provided to the output roller. In some examples, the print media with printing on both sides can be completely provided to the output tray.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A system for an inline duplexer media path, comprising:

a first print media pathway extending from an input roller to an output roller, wherein the first print media pathway includes a print zone roller to provide the print media through a print zone, and wherein the print zone roller is located within the print zone; and a second print media pathway extending from the output roller to the input roller, wherein the second print media pathway is substantially parallel to the first print media pathway and separated from the first print media pathway by a flipper.

2. The system of claim 1, wherein the print zone is between the input roller and the output roller within the first print media pathway.

3. The system of claim 1, wherein the output roller is a reversible roller.

4. The system of claim 1, wherein the flipper provides the print media to the second print media pathway when the print media passes the flipper.

5. The system of claim 4, wherein the output roller reverses when the print media passes the flipper.

6. A device with an inline duplexer media path, comprising:

a first print media pathway extending from an input roller to an output roller, wherein the first print media pathway includes a print zone roller to provide print media through a print zone, and wherein the print zone roller is located within the print zone;

a flipper between the output roller and the print zone to allow the print media to exit the first print media pathway to an output zone; and the output roller to reverse direction of the print media when the print media passes the flipper to provide the print media to a second print media pathway, wherein the second print media pathway provides the print media to the input roller to allow the print media to pass through the first print media pathway.

7. The device of claim 6, wherein the flipper includes a limiter to stop the flipper at a second position to receive the print media from the print zone.

8. The device of claim 6, comprising a clamping device between the output roller and an output tray to pinch the print media when the print media is provided to the second print media pathway.

9. The device of claim 6, wherein the flipper includes a pivot point to pivot a first side arm and a second pivot arm.

10. The device of claim 8, wherein the clamping device is disengaged to allow the print media to be overlapped on the output tray when the print media is provided to the second print media pathway.

11. The device of claim 8, wherein the flipper is a spring loaded flipper to allow the print media to pass over the flipper at an end of the first print media pathway and allow the print media to pass under the flipper at a beginning of the second print media pathway.

12. A method for an inline duplexer media path, comprising:

providing a first edge of print media to an input roller;

providing, via the input roller, the print media to a first print media pathway to be received at a print zone with a first side of the print media exposed to a print zone, wherein the first print media pathway includes a print zone roller to provide the print media through the print zone, and wherein the print zone roller is located within the print zone;

providing a portion of the print media to an output tray;

reversing the output roller to provide the print media to a second print media pathway that is separate and substantially parallel to the first print media pathway;

providing a second edge of the print media to the input roller; and providing, via the input roller, the print media to the first print media pathway to be received at the print zone with a second side of the print media exposed to the print zone.

13. The method of claim 12, wherein providing a portion of the print media to an output tray includes passing the print media through the output roller and activating a flipper to open the second print media pathway.

14. The method of claim 13, wherein activating the flipper closes the first print media pathway.

15. The method of claim 12, wherein providing a portion of the print media to an output tray includes adjusting a clamping device to allow the print media to overlap on the output tray.

* * * * *